US008844932B2

(12) United States Patent
Blaine et al.

(10) Patent No.: US 8,844,932 B2
(45) Date of Patent: Sep. 30, 2014

(54) SYSTEM AND METHOD FOR RETURNING A HOUSE ADVANTAGE IN A GAME OF CHANCE

(71) Applicant: Barrett Gaming International, Las Vegas, CA (US)

(72) Inventors: Peter Blaine, Las Vegas, NV (US); David S. Lee, Las Vegas, NV (US)

(73) Assignee: Barrett Gaming International, Las Vegas, NV (US)

( * ) Notice: Subject to any disclaimer, the term of this patent is extended or adjusted under 35 U.S.C. 154(b) by 0 days.

(21) Appl. No.: 13/911,918

(22) Filed: Jun. 6, 2013

(65) Prior Publication Data

US 2013/0344929 A1 Dec. 26, 2013

Related U.S. Application Data

(63) Continuation-in-part of application No. 13/340,423, filed on Dec. 29, 2011, now abandoned.

(60) Provisional application No. 61/429,520, filed on Jan. 4, 2011.

(51) Int. Cl.
*A63F 1/00* (2006.01)
*G07F 17/32* (2006.01)

(52) U.S. Cl.
CPC ..... *G07F 17/3288* (2013.01); *G07F 17/3293* (2013.01); *G07F 17/32* (2013.01)
USPC ..... 273/292; 463/13

(58) Field of Classification Search
USPC ..... 273/292; 463/13, 14
See application file for complete search history.

(56) References Cited

U.S. PATENT DOCUMENTS

| | | | | |
|---|---|---|---|---|
| 5,174,579 | A * | 12/1992 | Griffiths | 273/292 |
| 5,632,485 | A | 5/1997 | Woodland et al. | |
| 5,799,946 | A | 9/1998 | Groussman | |
| 6,095,525 | A | 8/2000 | Terminel | |
| 6,481,718 | B2 | 11/2002 | Koelling | |
| 6,808,173 | B2 | 10/2004 | Snow | |
| 2005/0012273 | A1 | 1/2005 | Bruno et al. | |
| 2007/0069468 | A1 * | 3/2007 | Chen et al. | 273/292 |
| 2007/0241505 | A1 | 10/2007 | Kling et al. | |
| 2010/0207327 | A1 * | 8/2010 | Fairhurst | 273/292 |
| 2010/0295247 | A1 | 11/2010 | Laduca et al. | |

* cited by examiner

*Primary Examiner* — Michael Dennis
(74) *Attorney, Agent, or Firm* — Michael A. Glenn; Perkins Coie LLP

(57) ABSTRACT

A form of play is disclosed that provides a house advantage in a blackjack side game.

6 Claims, 4 Drawing Sheets

| Dealer Bust 21 Pay Tables | | | | | |
|---|---|---|---|---|---|
| Outcome of Dealer's Hand | Dealer Upcard | Pay Table #1 | Pay Table #2 | Pay Table #3 | Pay Table #4 |
| Dealer Busts | A | 10 | 15 | 2 | 4 |
| Dealer Busts | T,J,Q,K | 4 | 4 | 2 | 4 |
| Dealer Busts | 7,8,9 | 2 | 2 | 2 | 4 |
| Dealer Busts | 2,3,4,5,6 | 1 | 1 | 2 | 1 |
| Dealer Doesn't Bust | Any | lose | lose | lose | lose |

FIGURE 2

| Dealer Bust 21 House Advantage | | | | |
|---|---|---|---|---|
| Game | Pay Table #1 | Pay Table #2 | Pay Table #3 | Pay Table #4 |
| 1 Deck, H17 | 7.375% | 1.975% | 13.755% | 2.594% |
| 1 Deck, S17 | 9.806% | 5.324% | 14.924% | 3.925% |
| 2 Decks, H17 | 7.722% | 2.351% | 14.066% | 2.879% |
| 2 Decks, S17 | 10.139% | 5.682% | 15.225% | 4.199% |
| 6 Decks, H17 | 7.949% | 2.597% | 14.272% | 3.066% |
| 6 Decks, S17 | 10.356% | 5.915% | 15.424% | 4.380% |
| 8 Decks, H17 | 7.978% | 2.628% | 14.298% | 3.089% |
| 8 Decks, S17 | 10.383% | 5.944% | 15.448% | 4.402% |

FIGURE 3

SYSTEM AND METHOD FOR RETURNING A HOUSE ADVANTAGE IN A GAME OF CHANCE

CROSS REFERENCE TO RELATED APPLICATIONS

This application is continuation-in-part of U.S. patent application Ser. No. 13/340,423, filed Dec. 29, 2011, which application claims priority to U.S. provisional parent application Ser. No. 61/429,520, filed Jan. 4, 2011, each of which is incorporated herein in its entirety by this reference thereto.

BACKGROUND OF THE INVENTION

1. Technical Field

The invention relates to games of chance. More particularly, the invention relates to a system and method for returning a house advantage in a game of chance.

2. Description of the Background Art

Blackjack, also known as Twenty-one or Vingt-et-un (French: "twenty-one"), is the most widely played casino banking game in the world. Blackjack is a comparing card game between a player and dealer and played with one or more French decks of 52 cards.

The player is dealt an initial two card hand with the option of drawing cards to bring the total value to 21 or less without exceeding it, so that the dealer will lose by having a lesser hand than the player or by exceeding 21. Many rule variations of blackjack exist. Since the 1960s, blackjack has been a high profile target of advantage players, particularly card counters, who track the profile of cards yet to be dealt, and adapt their wager and playing strategy accordingly.

At a casino blackjack table (see FIG. 1), the dealer faces between five to seven playing positions 10 from behind a semicircular table. At the beginning of each round, up to three players place their bets in a "betting box" 12 at each position in play. The player whose bet is at the front of the betting box is deemed to have control over the position, and the dealer will consult the controlling player for playing decisions regarding the hand; the other players of that box are said to "play behind." Any player is usually allowed to control or be in as many boxes as desired at a single table, but it is prohibited to play on more than one table at a time or to place multiple bets in a single box.

Each box is dealt an initial hand of two cards visible to the people playing on it, and often to any other players. The dealers hand receives its first card face up, and in "hole card" games receives its second card face down immediately (the hole card), which the dealer peeks at but does not reveal unless it makes the dealers hand a blackjack. Hole card games are sometimes played on tables with a small mirror or electronic sensor which are used to peek securely at the hole card. In European casinos, "no hole card" games are prevalent; the dealers second card is neither drawn nor consulted until the players have all played their hands.

Cards are dealt either from one or two hand-held decks, from a dealers shoe, or from a shuffling machine. Single cards are dealt to each of wagered-on position clockwise from the dealer's leftmost position, followed by a single card to the dealer, followed by an additional card to each of the positions in play. The players initial cards may be dealt face-up, or face-down (more common in single-deck games).

The players' object is to win money by creating card totals which will turn out to be higher than the dealer's hand, but without exceeding 21 ("busting"/"breaking"). On their turn, players must choose whether to "hit" (take a card), "stand" (end their turn), "double" (double wager, take a single card and finish), "split" (if the two cards have the same value, separate them to make two hands) or "surrender" (give up a half-bet and retire from the game). Number-cards count as their natural value; the jack, queen, and king (also known as "face cards" or "pictures") count as 10; aces are valued as either 1 or 11 according to the player's best interest. If the hand value exceeds 21 points, it busts, and all bets on it are immediately forfeit. After all boxes have finished playing, the dealer's hand is resolved by drawing cards until the hand busts or achieves a value of 17 or higher (a dealer total of 17 including an ace, or "soft 17," must be drawn to in some games and must stand in others). The dealer never doubles, splits nor surrenders. If the dealer busts, all remaining player hands win. If the dealer does not bust, each remaining bet wins if its hand is higher than the dealer's, and loses if it is lower. In the case of a tied score, known as "push" or "stand-off", bets are normally returned without adjustment; however, a blackjack beats any hand which is not a blackjack, even with value 21. Blackjack vs. blackjack is a push. Wins are paid out at 1:1, or equal to the wager, except for winning blackjacks, which are traditionally paid at 3:2, or one and a half times the wager. Many casinos today pay blackjacks at less than 3:2 at some tables.

Blackjack games almost always provide a side bet called insurance, which may be played when dealer's upcard 14 is an ace. At least one further side bet is usually provided.

If the dealer's upcard is an ace, the player is offered the option of taking "insurance" before the dealer checks the hole card.

Insurance is a side bet that the dealer has blackjack and is treated independently of the main wager. It pays 2:1 and is available when the dealer's exposed card is an ace. The idea is that the dealer's second card has a fairly high probability (nearly one-third) to be ten-valued, giving the dealer blackjack and disappointment for the player. It is attractive (although not necessarily wise) for the player to insure against the possibility of a dealer blackjack by making a maximum "insurance" bet, in which case the "insurance proceeds" will make up for the concomitant loss on the original bet. The player may add up to half the value of their original bet to the insurance and these extra chips are placed on a portion of the table usually marked "Insurance Pays 2 to 1."

Players with a blackjack may also take insurance, and in taking maximum insurance they commit themselves to winning an amount exactly equal to their main wager, regardless of the dealer's outcome. Fully insuring a blackjack against blackjack is thus referred to as "taking even money," and paid out immediately, before the dealer's hand is resolved; the players need not produce to place more chips for the insurance wager.

Insurance bets are expected to lose money in the long run, because the dealer is likely to have blackjack less than one-third of the time. However the insurance outcome is strongly anti-correlated with that of the main wager, and if the player's priority is to reduce variation, it is reasonable to pay for this.

Furthermore, the insurance bet is susceptible to advantage play. It is advantageous to make an insurance bet whenever the hole card has more than a chance of one in three of being a ten. Advantage play techniques can sometimes identify such situations. In a multi-hand, face-up, single deck game, it is possible to establish whether insurance is a good bet simply by observing the other cards on the table after the deal; even if there are just 2 player hands exposed, and neither of their two initial cards is a ten, then 16 in 47 of the remaining cards are tens, which is larger than 1 in 3, so insurance is a good bet.

This is an elementary example of the family of advantage play techniques known as card counting.

Bets to insure against blackjack are slightly less likely to be advantageous than insurance bets in general, since the ten in the player's blackjack makes it less likely that the dealer has blackjack too.

Many blackjack tables offer a side bet on various outcomes including:

- Player hand and dealer's up card sum to 19, 20, or 21 ("Lucky Lucky");
- Player initial hand is a pair ("Perfect pairs");
- Player initial hand is suited, suited and connected, or a suited K-Q ("Royal match");
- Player initial hand plus dealer's card makes a flush, straight, or three-of-a-kind poker hand ("21+3");
- Player initial hand totals 20 ("Lucky Ladies");
- Dealer upcard is in between the value of the players two cards ("In Bet");
- First card drawn to the dealer will result in a dealer bust ("Bust It!");
- One or both of the players cards is the same as the dealers card ("Match the Dealer"); and
- Player allowed to make optional second hand, and effectively receive the hand of 10, 8, or 18 without drawings cards ("Instant 18").

The side wager is typically placed in a designated area 16 next to the box for the main wager. A player wishing to wager on a side bet is usually required to place a wager on blackjack. Some games require that the blackjack wager should equal or exceed any side bet wager. A non-controlling player of a blackjack hand is usually permitted to place a side bet regardless of whether the controlling player does so.

The house edge for side games is generally higher than for the blackjack game itself. Nonetheless side games can be susceptible to card counting, often requiring bespoke counting systems. Most side games do not offer sufficient win rate to justify the effort of advantage play; exceptions are "Lucky ladies" and "Over/Under".

It would be advantageous to provide a house advantage in a blackjack side game,

SUMMARY OF THE INVENTION

The invention comprises a form of play that provides a house advantage in a blackjack side game.

BRIEF DESCRIPTION OF THE DRAWINGS

FIG. 2 shows a Dealer Bust 21 pay table according to the invention;

FIG. 3 is a table that shows the Dealer Bust 21 house advantage, depending on the pay table used, the number of decks, and the house rules, according to the invention.

DETAILED DESCRIPTION OF THE INVENTION

The invention comprises a form of play that provides a house advantage in a blackjack side game. An embodiment of the invention is referred to a Dealer Bust 21.

Rules for Dealer Bust 21

Figure 1:
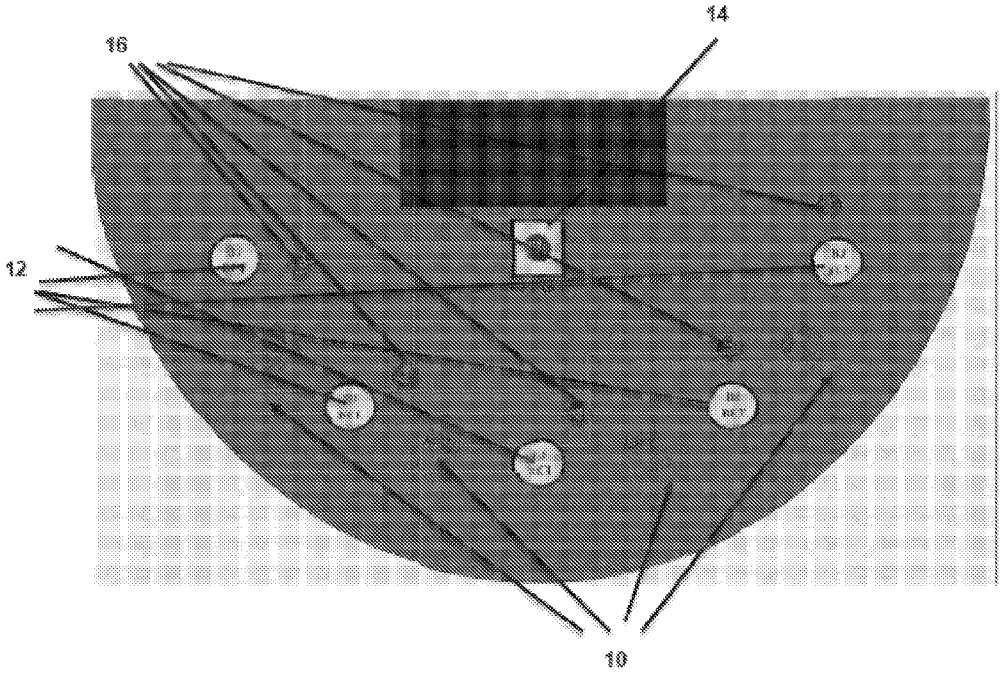
FIG. 1 is a schematic view of a blackjack game board.

1. Dealer Bust 21 is a blackjack side bet, available for blackjack dealt from 1, 2, 6, or 8 decks.
2. The player must place a blackjack bet to play the Dealer Bust 21 side bet.
3. If a player chooses to participate, an additional Dealer Bust 21 wager is placed in the designated area on the layout 16 (see FIG. 1).
4. In an embodiment, all bets must be placed prior to the dealer dealing any cards. In other embodiments, bets may be placed after the dealer begins dealing cards.
5. The Dealer Bust 21 side bet is resolved based on the final result of the dealers hand.
6. If one or more players make a Dealer Bust 21 side bet, then the dealer must play out his hand according to the house rules, regardless of whether all players have busted, have blackjack, or there otherwise are no players remaining with live blackjack hands.
7. The player wins the Dealer Bust 21 side bet if the dealer busts. The player is paid by reference to an associated one or one or more pay tables for the game and dealer upcard 14 (see FIG. 1). FIG. 2 shows a Dealer Bust 21 pay table.
8. Otherwise, if the dealer does not bust, the player loses and forfeits his Dealer Bust 21 wager.

Pay Tables and House Advantage

The four pay tables shown in FIG. 2 are available for the Dealer Bust 21 side bet. Other embodiments of the invention may have more or fewer pay tables. The pay table for a particular game is selected by the player or the house, based upon house rules, size of bet, etc. The payouts are divided into four categories based on the dealer upcard:

- The bust cards, 2, 3, 4, 5, 6;
- The intermediate cards, 7, 8, 9;
- The face cards, T, J, Q, K; and
- An ace, A.

For example, in the pay table 3, all pays are the same (2-to-1) for a dealer bust. In pay table 4, the player is paid 4-to-1 if the dealer busts with a non-bust card, otherwise the player is paid 1-to-1 (even money) for a dealer bust.

FIG. 3 is a table that shows the Dealer Bust 21 house advantage, depending on the pay table used, the number of decks, and the house rules. The rule that the dealer must hit soft 17 is denoted H17. The rule that the dealer must stand on soft 17 is denoted S17. Note that the dealer busts more often with the H17 rule than with the S17 rule. Therefore, for a fixed pay table, the game is more player-favorable with the H17 rule than the S 17 rule.

Methodology for the Mathematical Analysis of the Dealer Bust 21 Blackjack Side Bet The Dealer Bust 21 blackjack side bet was analyzed using programs written in the C++ programming language and combinatorial analysis. All dealer hands were played out in every possible way for every combination of dealer-up card (A, 2, 3, 4, 5, 6, 7, 8, 9, T, J, Q, K), number of decks (1, 2, 6, 8) and house rules (I-117, SI7). The results were tabulated and imported into Excel to complete the combinatorial analysis. Every house advantage given in FIG. 3 was audited using a computer program written in C++ that performed a Monte Carlo simulation. Each simulation consisted of at least one hundred million (100,000,000) rounds. The dealer bust frequencies were compared to results obtained from www.wizardofodds.com. These audits were consistent with the computations and combinatorial analysis given herein.

Computer Implementation

Figure 4:
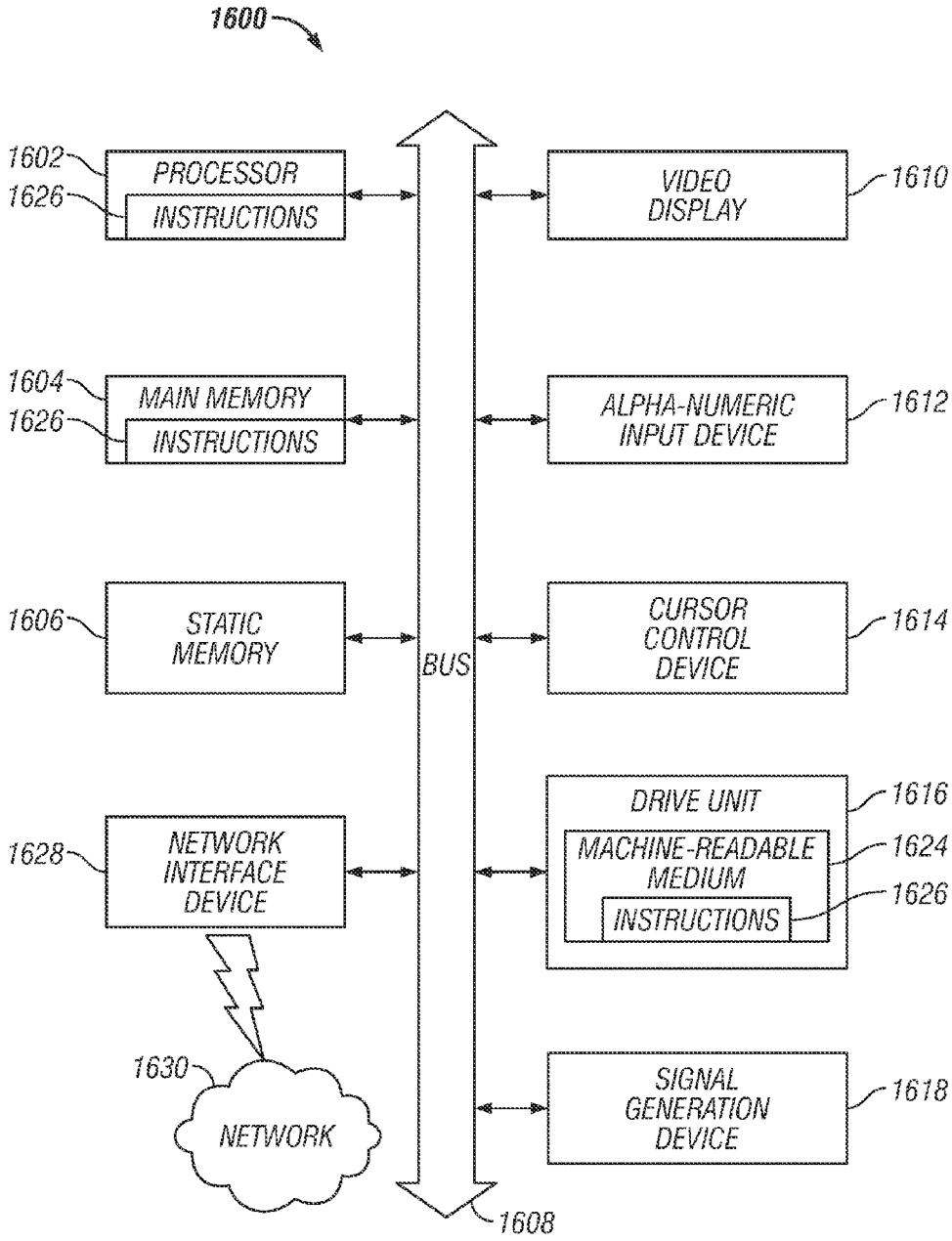
FIG. 4 is a block schematic diagram that depicts a machine in the exemplary form of a computer system within which a set of instructions for causing the machine to perform any of the herein disclosed methodologies may be executed.

FIG. 4 is a block schematic diagram that depicts a machine in the exemplary form of a computer system 1600 within which a set of instructions for causing the machine to perform any of the herein disclosed methodologies may be executed. In alternative embodiments, the machine may comprise or include a network router, a network switch, a network bridge, personal digital assistant (PDA), a cellular telephone, a Web appliance or any machine capable of executing or transmitting a sequence of instructions that specify actions to be taken.

The computer system 1600 includes a processor 1602, a main memory 1604 and a static memory 1606, which communicate with each other via a bus 1608. The computer system 1600 may further include a display unit 1610, for example, a liquid crystal display (LCD) or a cathode ray tube (CRT). The computer system 1600 also includes an alphanumeric input device 1612, for example, a keyboard; a cursor control device 1614, for example, a mouse; a disk drive unit 1616, a signal generation device 1618, for example, a speaker, and a network interface device 1628.

The disk drive unit 1616 includes a machine-readable medium 1624 on which is stored a set of executable instructions, i.e., software, 1626 embodying any one, or all, of the methodologies described herein below. The software 1626 is also shown to reside, completely or at least partially, within the main memory 1604 and/or within the processor 1602. The software 1626 may further be transmitted or received over a network 1630 by means of a network interface device 1628.

In contrast to the system 1600 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with CMOS (complementary metal oxide semiconductor), TTL (transistor-transistor logic), VLSI (very large systems integration), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g., a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A computer implemented method for returning a house advantage in a game of chance, comprising:

providing a game of chance having both a blackjack bet and a side bet;

requiring a player to place a blackjack bet as a condition for placing a side bet;

if a player chooses to place a side bet, receiving from the player an additional wager in a designated area on a play layout;

resolving said side bet based on a final result of the dealer's hand;

wherein if one or more players make a side bet, then the dealer must play out his hand according to house rules, regardless of whether all players have busted, have blackjack, or there otherwise are no players remaining with live blackjack hands;

wherein the player wins the side bet if the dealer busts;

wherein the player is paid by reference to a pay table for the game and a dealer upcard;

wherein if the dealer does not bust, the player's wager is lost and forfeited;

wherein payouts are divided into four categories based on a dealer upcard as follows:

bust cards, 2, 3, 4, 5, 6;

intermediate cards, 7, 8, 9;

face cards, T, J, Q, K; and ace, A; and wherein said pay tables comprise any of:

| Outcome of Dealer's Hand | Dealer Upcard | Pay Table #1 | Pay Table #2 | Pay Table #3 | Pay Table #4 |
|---|---|---|---|---|---|
| Dealer Busts | A | 10 | 15 | 2 | 4 |
| Dealer Busts | T, J, Q, K | 4 | 4 | 2 | 4 |
| Dealer Busts | 7, 8, 9 | 2 | 2 | 2 | 4 |
| Dealer Busts | 2, 3, 4, 5, 6 | 1 | 1 | 2 | 1 |
| Dealer Doesn't Bust. | Any | lose | lose | lose | lose |

2. The method of claim 1, wherein said side bet comprises a blackjack side bet for blackjack dealt from any of 1, 2, 6, or 8 decks.

3. The method of claim 1, wherein all bets must be placed prior to a dealer dealing any cards.

4. A system for returning a house advantage in a game of chance, comprising:

said system providing a game of chance having both a blackjack bet and a side bet;

said system requiring a player to place a blackjack bet as a condition for placing a side bet;

if a player chooses to place a side bet, said system receiving from the player an additional wager in a designated area on a play layout;

said system resolving said side bet based on a final result of the dealer's hand;

wherein if one or more players make a side bet, then the dealer must play out his hand according to house rules, regardless of whether all players have busted, have blackjack, or there otherwise are no players remaining with live blackjack hands;

wherein the player wins the side bet if the dealer busts;

wherein the player is paid by reference to a pay table for the game and a dealer upcard;

wherein if the dealer does not bust, the player's wager is lost and forfeited;

wherein payouts are divided into four categories based on a dealer upcard as follows:

bust cards, 2, 3, 4, 5, 6;

intermediate cards, 7, 8, 9;

face cards, T, J, Q, K; and ace, A; and wherein said pay tables comprise any of:

| Outcome of Dealer's Hand | Dealer Upcard | Pay Table #1 | Pay Table #2 | Pay Table #3 | Pay Table #4 |
|---|---|---|---|---|---|
| Dealer Busts | A | 10 | 15 | 2 | 4 |
| Dealer Busts | T, J, Q, K | 4 | 4 | 2 | 4 |
| Dealer Busts | 7, 8, 9 | 2 | 2 | 2 | 4 |
| Dealer Busts | 2, 3, 4, 5, 6 | 1 | 1 | 2 | 1 |
| Dealer Doesn't Bust. | Any | lose | lose | lose | lose |

5. The system of claim 4, wherein said side bet comprises a blackjack side bet for blackjack dealt from any of 1, 2, 6, or 8 decks.

6. The system of claim 4, wherein all bets must be placed prior to a dealer dealing any cards.

* * * * *